US007127782B1

(12) United States Patent
Skiles

(10) Patent No.: US 7,127,782 B1
(45) Date of Patent: Oct. 31, 2006

(54) CLASP FOR ORNAMENTAL OBJECTS

(76) Inventor: William Skiles, 5901 E. Rosewood, Tucson, AZ (US) 85711

( * ) Notice: Subject to any disclaimer, the term of this patent is extended or adjusted under 35 U.S.C. 154(b) by 0 days.

(21) Appl. No.: 10/994,729

(22) Filed: Nov. 22, 2004

Related U.S. Application Data

(63) Continuation of application No. 09/818,463, filed on Mar. 27, 2001, now Pat. No. 6,898,828.

(51) Int. Cl.
*A41F 1/00* (2006.01)

(52) U.S. Cl. ..... 24/530; 24/564; 63/40

(58) Field of Classification Search ..... 24/459, 24/480, 484, 530, 545, 547, 564, 570, 571; 63/29.1, 30, 31, 40
See application file for complete search history.

(56) References Cited

U.S. PATENT DOCUMENTS

| | | | | |
|---|---|---|---|---|
| 1,251,308 | A * | 12/1917 | Wecht | 24/564 |
| 3,014,298 | A * | 12/1961 | Kirshner | 63/29.1 |
| 3,693,376 | A * | 9/1972 | Willner | 63/29.1 X |
| 3,896,527 | A * | 7/1975 | Miller et al. | 24/499 |
| 4,139,667 | A | 2/1979 | Blue | 428/38 |
| 4,195,492 | A * | 4/1980 | Johnson | 63/29.1 X |
| 4,457,756 | A | 7/1984 | Kern et al. | 604/286 |
| 4,536,924 | A * | 8/1985 | Willoughby | 24/545 X |
| 4,625,526 | A * | 12/1986 | Milawski | 63/29.1 X |
| 4,835,824 | A * | 6/1989 | Durham et al. | 24/339 |
| 5,022,126 | A * | 6/1991 | Davis | 24/543 |
| 5,129,730 | A * | 7/1992 | Someah et al. | 366/160.5 |
| 5,433,090 | A * | 7/1995 | Santiago | 63/29.1 |
| 5,440,791 | A * | 8/1995 | Guio | 24/545 |
| D363,545 | S | 10/1995 | Miller | D24/143 |
| 5,803,687 | A | 9/1998 | Ledingham | 411/85 |
| 5,946,943 | A * | 9/1999 | Hanson | 63/29.1 X |
| D426,767 | S * | 6/2000 | Meyers | D8/395 |
| 6,101,655 | A * | 8/2000 | Buddle | 12/146 C |
| 6,127,457 | A * | 10/2000 | Darling | 523/218 |
| 6,898,828 | B1 * | 5/2005 | Skiles | 24/530 |
| 6,925,687 | B1 * | 8/2005 | Overton | 24/543 |

FOREIGN PATENT DOCUMENTS

| | | | | |
|---|---|---|---|---|
| DE | 31 04 396 A1 * | 8/1982 | | 63/29.1 |

* cited by examiner

*Primary Examiner*—Robert J. Sandy
*Assistant Examiner*—Ruth C. Rodriguez
(74) *Attorney, Agent, or Firm*—Hayes Soloway P.C.

(57) ABSTRACT

A clasp apparatus to releaseably hold an ornamental object. That ornamental object may have a spherical shape or an irregular shape. A method to releaseably hold an ornamental object.

17 Claims, 9 Drawing Sheets

CLASP FOR ORNAMENTAL OBJECTS

This application is a continuation of U.S. patent application Ser. No. 09/818,463, filed Mar. 27, 2001 now U.S. Pat. No. 6,898,828.

FIELD OF THE INVENTION

The present invention relates to an improved apparatus for releaseably fixturing an ornamental object.

BACKGROUND OF THE INVENTION

An ornamental object can be converted into a piece of jewelry by adding thereto an attachment fixture which facilitates display of the ornament. Different types of jewelry have different types of attachment fixtures. Jewelry such as rings and necklaces must be equipped with fixtures which facilitate attachment of an ornament to particular parts of the human body, while lapel pins and belt buckles have fixtures designed to facilitate attachment of the ornament to particular pieces of clothing.

Using prior art devices, the unique nature of each type of attachment fixture limits the versatility of the jewelry. In addition, prior art attachment fixtures often alter, mar, and to some degree damage, the piece of jewelry to which those fixtures are affixed. Furthermore, the additional bulk also prevented proper display of the jewelry by causing it to stand away from the body or tilt to one side.

What is needed is a clasp that securely and releaseably holds an ornamental object such that the securely/releaseably fixtured ornamental object can we worn as a piece of jewelry, and subsequently easily removed from that clasp. In addition, what is needed is a clasp that can be disposed in a wide array of jewelry, such that a single ornamental object can be securely/releaseably displayed in a variety of jewelry pieces, including pendants, necklaces, ear-rings, and the like. Moreover, what is needed is a secure/releasable clasp device that does not detract from the overall appearance of the ornament.

SUMMARY OF THE INVENTION

Applicant's invention includes a clasp for releaseably holding an ornamental object. That ornamental object can have a spherical shape, an essentially spherical shape, or an irregular shape. Applicants' clasp includes a first fixture having a first surface and a second surface, where that first surface has a concave shape. Applicant's invention further includes a second fixture having a first surface and a second surface, where that first surface has a concave shape. Applicant's invention further includes a member having a first end and a second end, wherein the first end is disposed on the second surface of the first fixture, and wherein the second end is disposed on the second surface of the second fixture.

Applicant's invention also includes a method to releaseably fixture an ornamental object. Using Applicant's method and Applicant's clasp device, an ornamental object is inserted between the first fixture and the second fixture portions of Applicant's clasp. The first fixture presses the ornamental object against the second fixture while the second fixture presses the ornamental object against the first fixture.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

Figure 1:
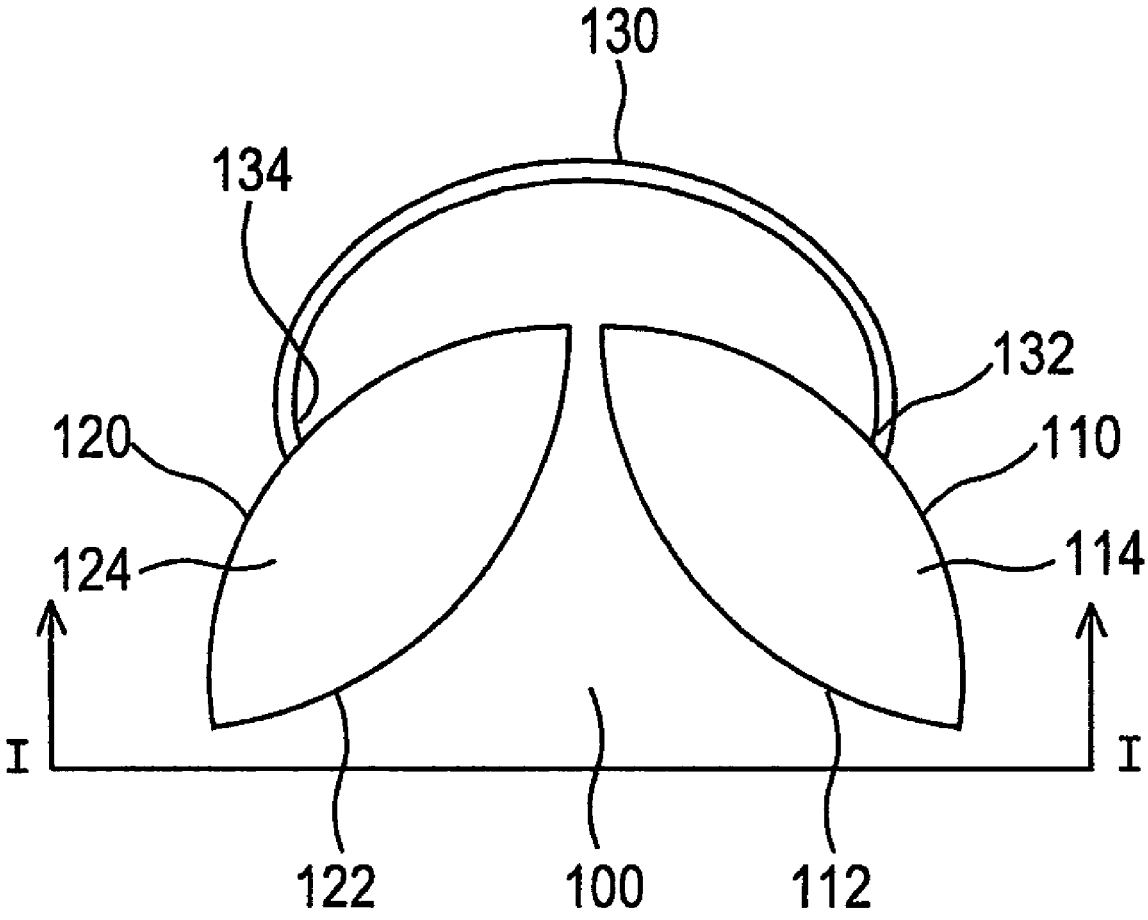
FIG. 1 is a side view of one embodiment of Applicant's clasp apparatus.

Referring to FIG. 1, clasp 100 includes first fixture 110, second fixture 120, and member 130. First fixture 110 includes outer surface 114. Second fixture 120 includes outer surface 124. Member 130 includes first end 132 and second end 134. First end 132 is disposed on outer surface 114. Second end 134 is disposed on outer surface 124. In the embodiment shown in FIG. 1, member 130 has a semicircular shape. In other embodiments, member 130 has a U-shape or an irregular shape.

Figure 2A:
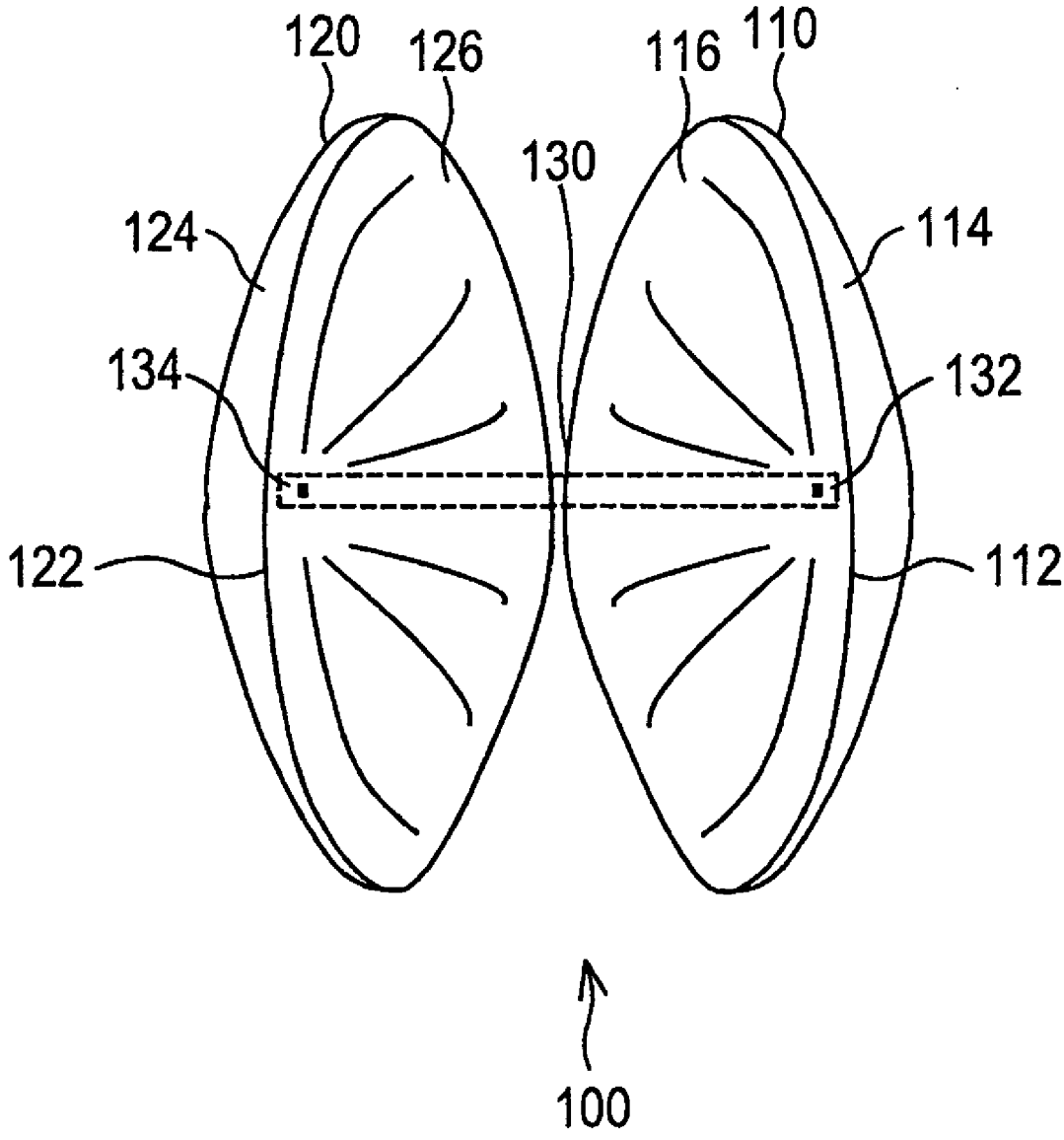
FIG. 2A is a view along the I—I axis of that first embodiment.

Referring to FIG. 2A, first fixture 110 further includes inner surface 116. Outer surface 114 and inner surface 116 are continuously joined by first edge 112. In the embodiment shown in FIGS. 1 and 2A, first fixture 110 has a convexoconcave shape wherein inner surface 116 has a concave shape and outer surface 114 has a convex shape. In alternative embodiments, first fixture 110 has a planoconcave shape wherein inner surface 116 has a concave shape and outer surface 114 has a flat shape.

Second fixture 120 further includes inner surface 126. Outer surface 124 and inner surface 126 are continuously joined by second edge 122. In the embodiment shown in FIGS. 1 and 2A, second fixture 120 has a convexoconcave shape wherein inner surface 126 has a concave shape and outer surface 124 has a convex shape. In alternative embodiments, second fixture 120 has a planoconcave shape wherein inner surface 126 has a concave shape and outer surface 124 has a flat shape.

In certain embodiments, first fixture 110 and second fixture 120 have the same dimensions and shape. In alternative embodiments, first fixture 110 and second fixture 120 have differing dimensions and/or differing shapes.

First fixture 110, second fixture 120, and member 130 can be formed from any rigid material including plastic, metal, wood, or combinations thereof. Outer surfaces 114 and 124 can be sanded or ground to be substantially smooth. Optionally, outer surfaces 114 and 124 can be covered with paint, a lacquer, or other finish treatment.

Figure 2B:
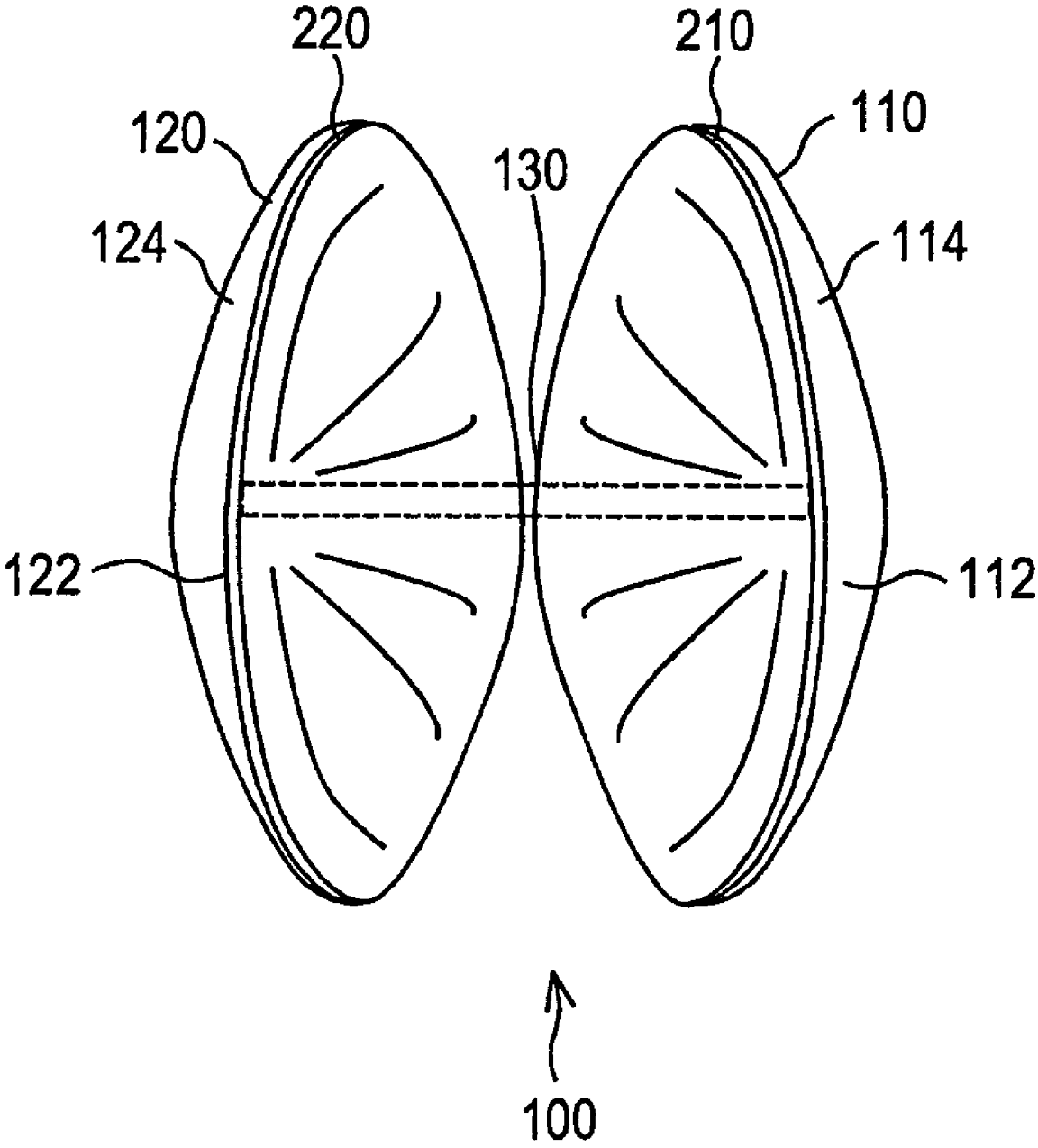
FIG. 2B is a side view along the I—I axis of a second embodiment of Applicant's clasp apparatus.

In an alternative embodiment shown in FIG. 2B, flexible cellular material 210 is disposed on inner surface 116 of first fixture 110. Flexible cellular material 210 comprises a polyethylene foam, a polyurethane foam, and the like. The thickness of cellular material 210 is between about 0.10 inches and about 0.25 inch. Flexible cellular material 210 has a density of at least about 1.8 pounds per cubic foot. Flexible cellular material 210 has an ILD at 25% compression of between about 18 pounds of pressure and about 59 pounds of pressure. Those skilled in the art will appreciate that "ILD" stands for Indentation Load Deflection, and refers to the firmness of a piece of foam. In order to determine a flexible cellular material's ILD, a testing laboratory places a 4"×15"×15" piece of that foam on a flat surface. Then a round metal plate, 12" in diameter, pushes down on that piece of foam. The amount of pounds of pressure it takes to squeeze that 4" piece of foam to 3 inches (25% compression) is referred to as the ILD.

Flexible cellular material 220 is disposed on inner surface 126 of fixture 120. Flexible cellular material 220 comprises a polyethylene foam, a polyurethane foam, and the like. The thickness of cellular material 220 is between about 0.10 inches and about 0.25 inch. Flexible cellular material 220 has a density of at least about 1.8 pounds per cubic foot. Flexible cellular material 220 has an ILD at 25% compression of between about 18 pounds of pressure and about 59 pounds of pressure.

Flexible cellular material 210 and flexible cellular material 220 may have the same or differing compositions, densities, thicknesses, and/or ILDs. These foams serve multiple purposes. First, flexible cellular material 210 and flexible cellular material 220 protect the surface of the ornamental object fixtured.

Second, these foams allow secure fixturing of ornamental objects that are not spherical or substantially spherical, but rather have irregular shapes. When such an irregularly shaped object is inserted between first fixture 110 and second fixture 120, first flexible cellular material 210 and second flexible cellular material 220 each conform to the shape of those portions of the irregularly-shaped object to which those materials are in contact, thereby securely, but releaseably, holding that irregularly shaped object in the clasp device.

Figure 3:
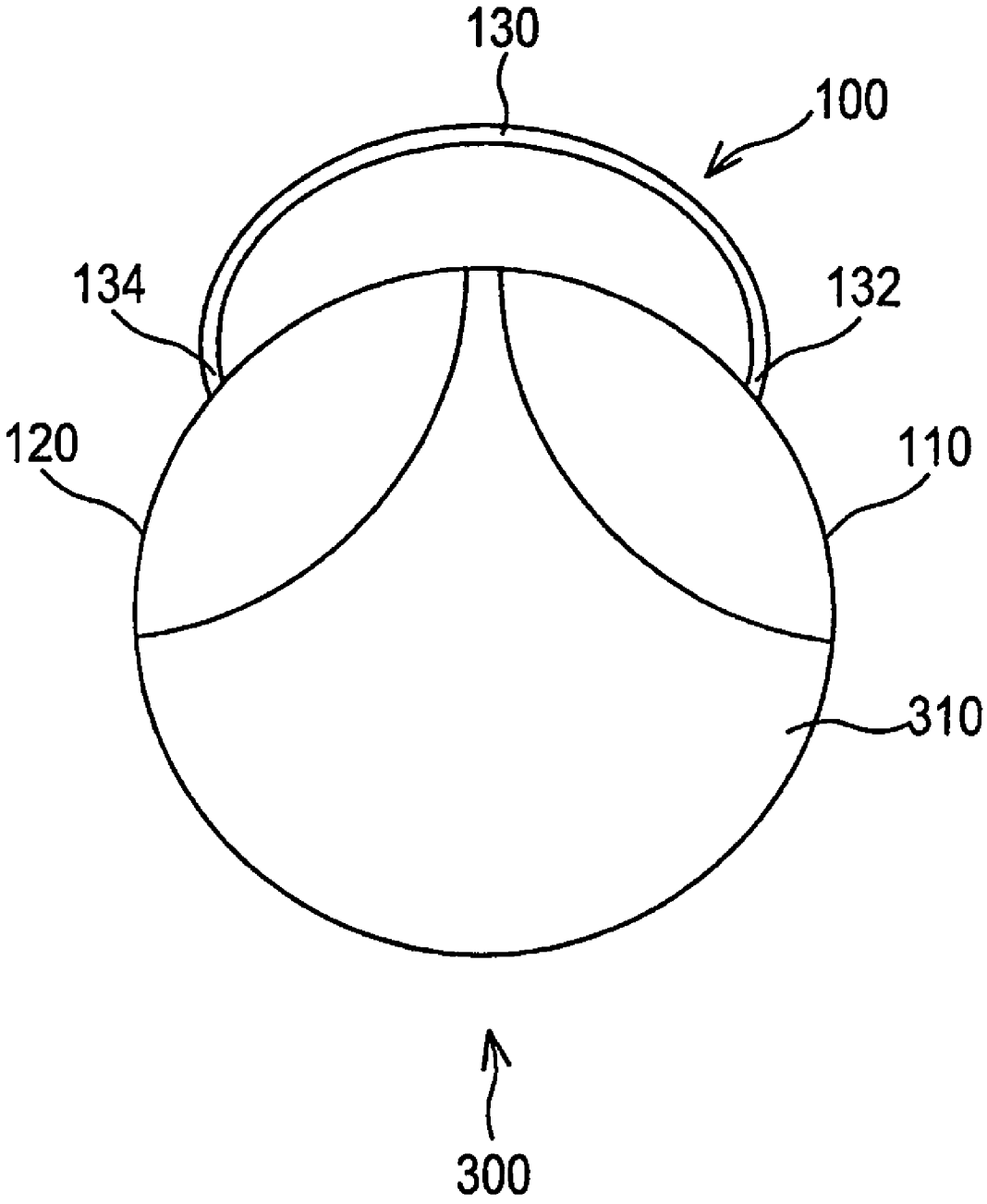
FIG. 3 is a side view of Applicant's clasp apparatus releaseably holding an ornamental object.

Turning to FIG. 3, apparatus 300 comprises a piece of jewelry which includes clasp 100 releaseably fixturing ornamental object 310. Ornamental object 310 comprises both natural and human-made objects, including but not limited to ornamental stones, clear and/or tinted marbles, and precious gems such as diamonds, rubies, and the like. In the embodiment shown in FIG. 3, ornamental object 310 has a spherical shape. In other embodiments, ornamental object 310 has an irregular shape.

Figure 4A:
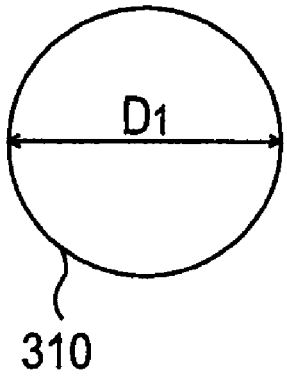
FIG. 4A is a side view of the ornamental object shown in FIG. 3.
Figure 4B:
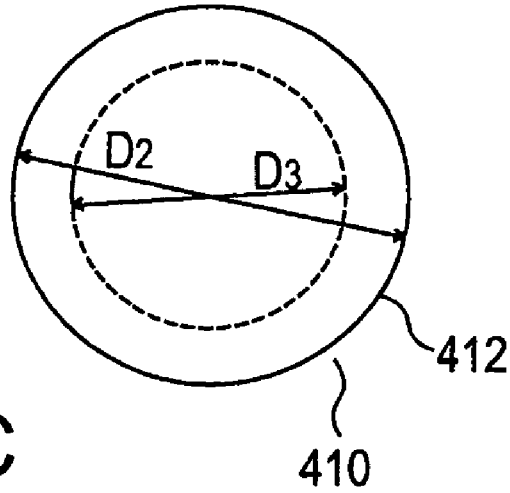
FIG. 4B shows a side view of a spherical-shaped shell.

FIGS. 4*a* through 4D illustrate the relationship between the dimensions of fixture 110, fixture 120, and ornamental object 310. Referring to FIG. 4A, ornamental object 310 has a diameter D1. Referring to FIG. 4B, spherical-shaped shell 410 has outer surface 412 having a diameter D2 and an inner surface having a diameter D3. Diameter D3 is substantially equal to diameter D1. By substantially equal, Applicant means diameter D3 equals diameter D1 plus or minus ten percent (+/−10%).

Figure 4C:
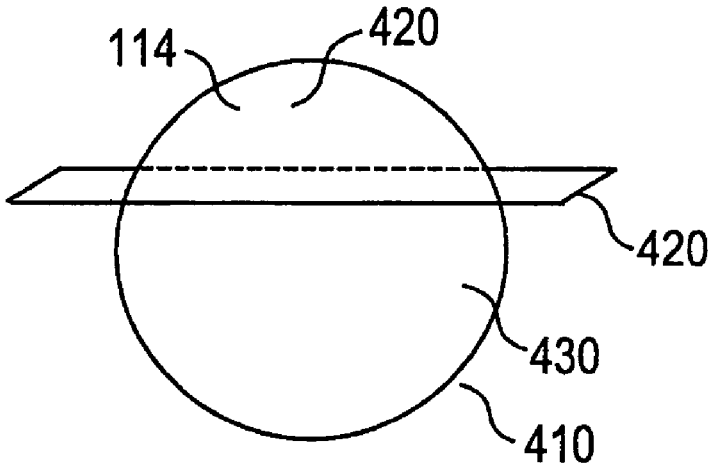
FIG. 4C shows a plane truncating the spherical-shaped shell of FIG. 3.
Figure 4D:
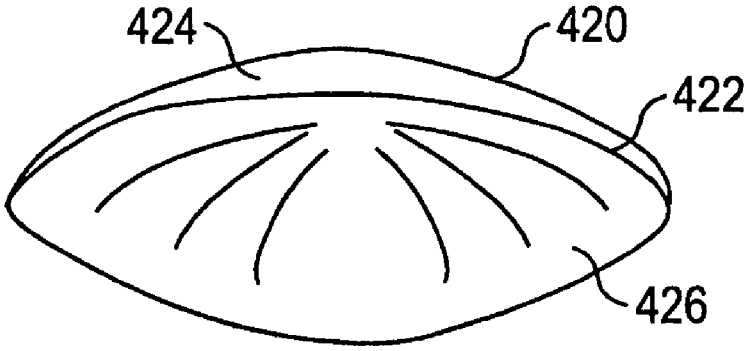
FIG. 4D shows a truncated portion of that spherical-shaped shell.

Fixture 110 and fixture 120 (FIGS. 1, 2A, 2B, 3) comprise truncated portions of spherical-shaped shell 410. Referring to FIG. 4C, plane 420 bisects shell 410 to form first truncated spherical shell 420 and second truncated spherical shell 430. First truncated spherical shell 420 includes outer surface 424, inner surface 426, and edge 422 which continuously joins inner outer surface 424 and inner surface 426. Fixture 110 (FIG. 3) and/or fixture 120 (FIG. 3) can comprise first truncated spherical shell 420.

Figure 5:
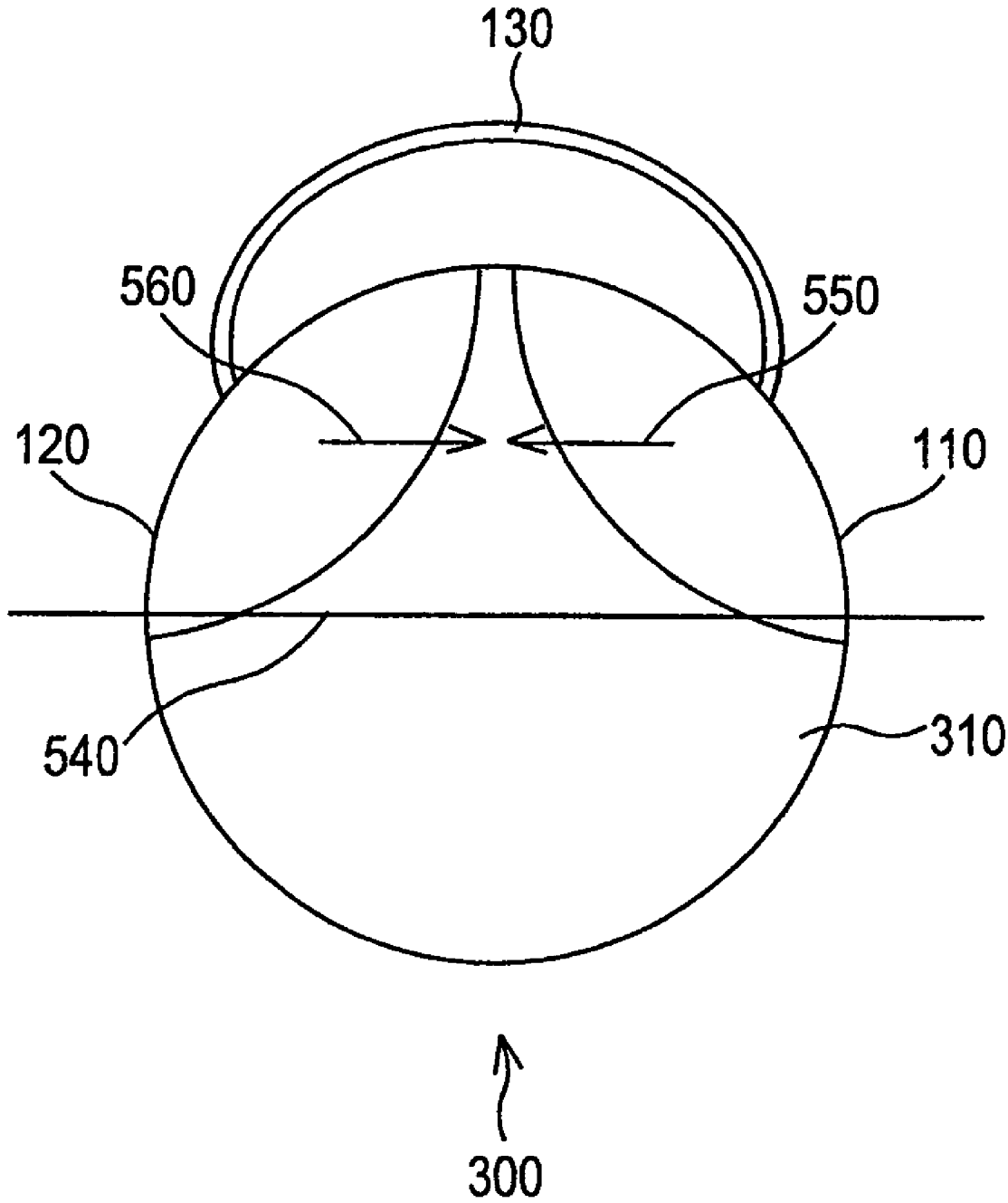
FIG. 5 is a side view showing the forces used by Applicant's invention to releaseably hold an ornamental object.

Referring now to FIG. 5, ornamental object 310 having diameter D1 (FIG. 4A) is releaseably fixtured in apparatus 300. Apparatus 300 includes first fixture 110, second fixture 120, and member 130. First fixture 110 and second fixture 120 comprise truncated portions of spherical shells having outer diameters D2 (FIG. 4B) and inner diameters D3 (FIG. 4B), such that inner diameters D3 are substantially equal to diameter D1. Inner surface 116 (FIG. 2) of first fixture 110 contacts object 310. Inner surface 126 (FIG. 2) of second fixture 120 contacts object 310.

Diameter 540 comprises that diameter of object 310 which symmetrically intersects both first fixture 110 and second fixture 120. The sizes and orientations of first fixture 110 and second fixture 120 are adjusted such that no portion of first fixture 110 overlaps any portion of second fixture 120, and such that at least one diameter of object 310, such as diameter 540, intersects some portion of both first fixture 110 and some portion of second fixture 120.

Referring again to FIG. 5, first fixture 100 exerts first force 550 against object 310 urging object 310 into tight contact with second fixture 120. Similarly, second fixture 120 exerts second force 560 against object 310 urging object 310 into tight contact with first fixture 110. First force 550 in combination with second force 560 securely but releaseably holds ornamental object 310 in clasp apparatus 300. The magnitude of first force 550 can be adjusted by varying, for example, the area of inner surface 116 in contact with object 310. Similarly, the magnitude of second force 560 can be adjusted by, for example, varying the area of inner surface 126 in contact with object 310. As those areas of contact are increased, forces 550 and 560, respectively are increased. First force 550 and second force 560 can also be adjusted by varying the thickness and composition of member 130. For example, as the flexural modulus of member 130 increases, the magnitudes of first force 550 and second force 560 also increase.

Figure 6:
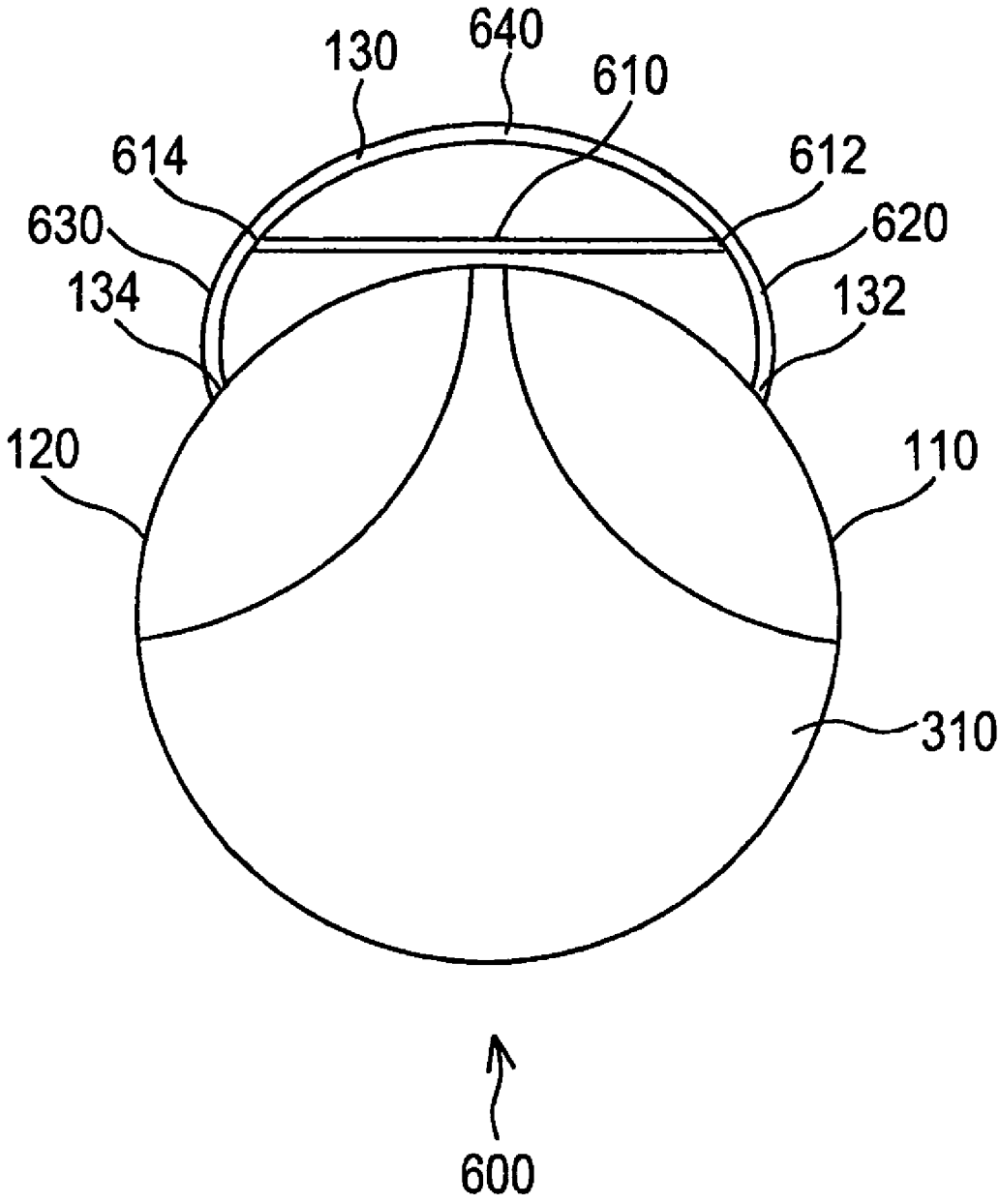
FIG. 6 is a side view of a third embodiment of Applicant's clasp apparatus.

Referring to FIG. 6, apparatus 600 includes member 130 disposed between first fixture 110 and second fixture 120. Member 130 includes first end 132 connected to first fixture 110 and second end 134 connected to second fixture 120. Member 130 further includes first end component 620, second end component 630, and midpoint 640. First end component 620 connects first end 132 and midpoint 640. Second end component 630 connects second end 134 and midpoint 640. Closure apparatus 610 includes first end 612 and second end 614. First end 614 connects to first end component 620. Second end 614 connects to second end component 630. Closure apparatus 610 acts to shorten the distance between first end 134 of member 130 and second end 132 of member 130, thereby increasing the resultant compressive force fixturing ornamental object 310.

Figure 7:
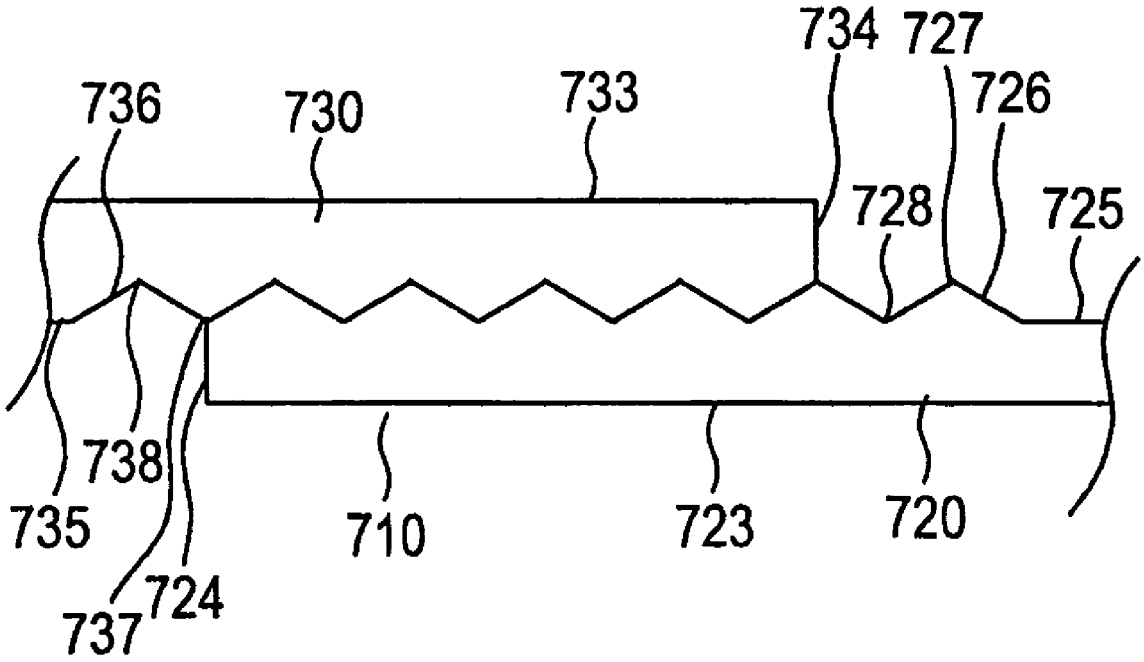
FIG. 7 is a side view of one embodiment of a closure device used in Applicant's third embodiment.

FIG. 7 shows an embodiment wherein closure apparatus 710 includes first connector 720 and second connector 730. First connector 720 includes proximal end (not shown in FIG. 7) disposed on first end portion 620 (FIG. 6) and distal end 724 extending outwardly from first end portion 620 in the direction of second end portion 630 (FIG. 6). Second connector 730 includes proximal end (not shown in FIG. 7) connected to second end portion 630 (FIG. 6) and distal end 734 extending outwardly from second end portion 630 in the direction of first end portion 620.

First connector 720 includes first surface 723 and opposing surface 725. Surface 725 includes a ratchet portion 726 comprising alternating elevated segments 727 and lowered segments 728. Second connector 730 includes first surface 733 and opposing surface 735. Surface 735 includes a ratchet portion 736 comprising alternating elevated segments 737 and lowered segments 738. Distal end 724 is disposed adjacent distal end 734 such that ratchet portion 726 slidingly mates with ratchet portion 736.

Urging first end portion 620 (FIG. 6) and second end portion 630 (FIG. 6) inwardly toward each other causes connector 720 to slide over connector 730 thereby reducing the distance between first end portion 620 and second end portion 630. Ratchet portions 726 and 736 slidingly mate to maintain that shortened distance when the inwardly directed forces on first end portion 620 and second end portion 630 are discontinued. As those skilled in the art will appreciate, decreasing the distance between first end portion 620 and second end portion 630 increases first force 550 (FIG. 5) and second force 560 (FIG. 5).

Figure 8:
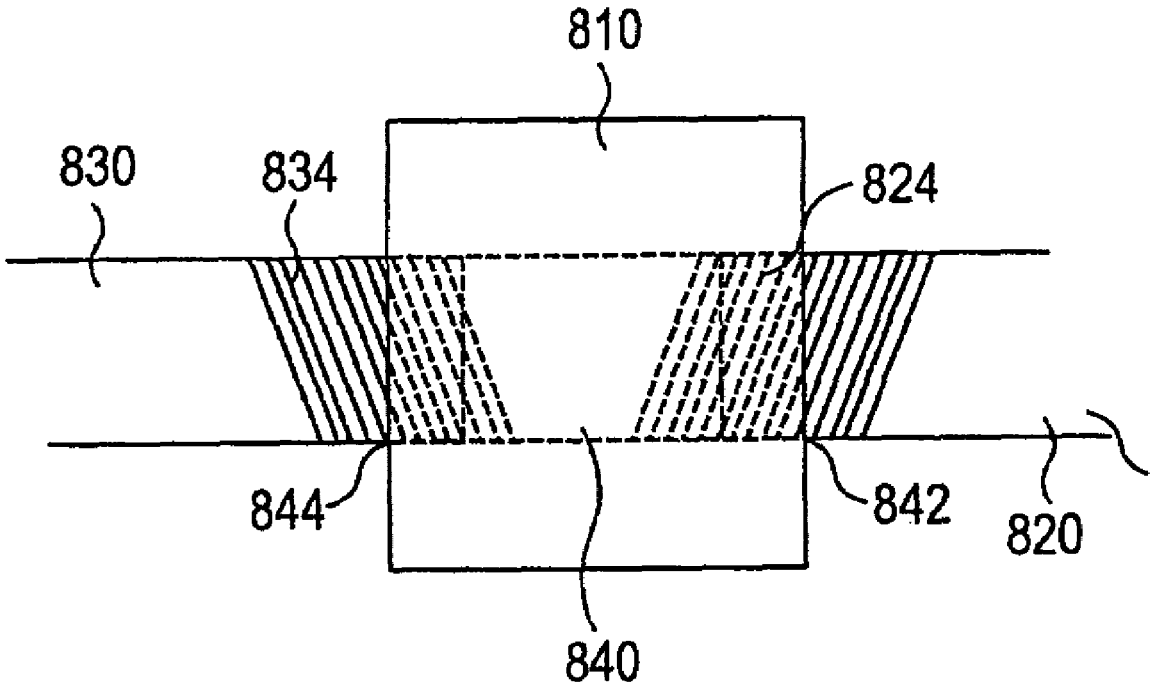
FIG. 8 is a side view of another embodiment of a closure device used in Applicant's third embodiment.

Referring to FIG. 8, closure apparatus 610 (FIG. 6) comprises first connector 820, second connector 830, and body 810. First connector 820 includes proximal end (not shown in FIG. 8) disposed on first end portion 620 (FIG. 6) and first threaded distal end 824 extending outwardly from first end portion 620 in the direction of second end portion 630 (FIG. 6). Second connector 830 includes proximal end (not shown in FIG. 7) connected to second end portion 630 (FIG. 6) and second threaded distal end 834 extending outwardly from second end portion 630 in the direction of first end portion 620.

First threaded distal end 824 is threaded in a first orientation and second threaded distal end 834 is threaded in a second orientation. Body 810 includes aperture 840 disposed therethrough. Aperture 840 includes first opening 842 and second opening 844. First opening 842 is threaded in the first orientation. Second opening 844 is threaded the second orientation.

Body 810 is rotatably disposed on both connector 820 and connector 830. First threaded distal end 824 is rotatably disposed within first opening 842. Second threaded distal end 834 is rotatably disposed within second opening 844. Rotation of body 810 in a first direction causes first connector 820 and second connector 830 to be drawn inwardly thereby decreasing the distance between first end portion 620 (FIG. 6) and second end portion 630 (FIG. 6).

While the preferred embodiments of the present invention have been illustrated in detail, it should be apparent that modifications and adaptations to those embodiments may occur to one skilled in the art without departing from the scope of the present invention as set forth in the following claims.

I claim:

1. A jewelry clasp for releaseably compressively connecting an ornamental object, comprising:

a first semi-spherically shaped fixture comprising a truncated portion of a first spherical shell having a first inner concave surface, a first outer convex surface, and a first edge continuously joining said first inner concave surface and said first outer convex surface;

a second semi-spherically shaped fixture comprising a truncated portion of a second spherical shell having a second inner concave surface and a second outer convex surface, and a second edge continuously joining said second inner concave surface and said second outer convex surface; and a spring member having a first end and a second end, wherein said first end is affixed directly to said first outer convex surface of said first fixture and said second end is affixed directly to said second outer convex surface of said second fixture, whereupon said ornamental object is compressively held between said first and second semi-spherically shaped fixtures, said spring member having a closed portion defining an aperture formed therein.

2. The clasp of claim 1, wherein said first end is affixed interiorly of said first edge to said first fixture and said second end is affixed interiorly of said second edge to said second fixture.

3. The clasp of claim 1, wherein said inner surface of said first fixture is covered by a first cellular material and said inner surface of said second fixture is covered by a second cellular material.

4. The clasp of claim 1, wherein said necklace or chain is connected to said clasp through said spring member.

5. A clasp as claimed in claim 1, in combination with a piece of jewelry.

6. A clasp as claimed in claim 5, wherein the jewelry is selected from the group consisting of a pendant, a necklace, an ear-ring, a pin, a ring and a buckle.

7. A jewelry clasp for connecting an ornamental object, comprising:

a first fixture comprising a first convexoconcave structure having a first inner concave surface, a first outer convex surface, and a first edge continuously joining said first inner concave surface and said first outer convex surface;

a second fixture comprising a second convexoconcave structure having a second inner concave surface and a second outer convex surface, and a second edge continuously joining said second inner concave surface and said second outer convex surface; and a spring member having a first end and a second end, wherein said first end is affixed to said first outer convex surface of said first fixture, and wherein said second end is affixed to said second outer convex surface of said second fixture, wherein said spring member contains a closed portion defining an aperture formed therein.

8. The clasp of claim 7, in combination with a necklace or chain.

9. The clasp of claim 7, wherein said first end is directly affixed to said first outer convex surface of said first fixture and said first end is directly affixed to said second outer convex surface of said second fixture.

10. The clasp of claim 8, wherein said necklace or chain is connected to said clasp through the closed portion of said spring member.

11. A clasp as claimed in claim 7, in combination with a piece of jewelry.

12. A clasp as claimed in claim 11, wherein the jewelry is selected from the group consisting of a pendant, a necklace, an ear-ring, a pin, a ring and a buckle.

13. A clasp for releaseably compressively connecting an ornamental object to a necklace or chain, comprising:

a first semi-spherically shaped fixture comprising a truncated portion of a first spherical shell having a first inner concave surface, a first outer convex surface, and a first edge continuously joining said first inner concave surface and said first outer convex surface;

a second semi-spherically shaped fixture comprising a truncated portion of a second spherical shell having a second inner concave surface and a second outer convex surface, and a second edge continuously joining said second inner concave surface and said second outer convex surface; and a spring member having a first end and a second end, wherein said first end is affixed directly to said first outer convex surface of said first fixture and said second end is affixed directly to said second outer convex surface of said second fixture, whereupon said spherically shaped ornamental object is compressively held between said first and second semi-spherically shaped fixtures, and wherein said clasp has a unitary construction, and said spring member has a closed portion defining an aperture formed therein.

14. The clasp of claim 13, wherein said first semi-spherically shaped fixture, said second semi-spherically shaped fixture, and said spring are constructed of plastic.

15. The clasp of claim 13, wherein said first semi-spherically shaped fixture, said second semi-spherically shaped fixture, and said spring are constructed of metal.

16. A clasp as claimed in claim 13, in combination with a piece of jewelry.

17. A clasp as claimed in claim 16, wherein the jewelry is selected from the group consisting of a pendant, a necklace, an ear-ring, a pin, a ring and a buckle.

* * * * *